United States Patent [19]

Florentine

[11] 4,312,261

[45] Jan. 26, 1982

[54] APPARATUS FOR WEAVING A THREE-DIMENSIONAL ARTICLE

[76] Inventor: Robert A. Florentine, 26 S. Wakefield Rd., Norristown, Pa. 19401

[21] Appl. No.: 153,623

[22] Filed: May 27, 1980

[51] Int. Cl.[3] ..... D04C 1/00

[52] U.S. Cl. ..... 87/33; 87/37

[58] Field of Search ..... 139/11, 13, 16, 455; 87/33, 34, 8, 53; 264/45

[56] References Cited

U.S. PATENT DOCUMENTS

| | | | |
|---|---|---|---|
| 2,063,734 | 12/1936 | Hale et al. | 139/455 |
| 2,412,353 | 12/1946 | Parker | 139/11 |
| 3,322,868 | 5/1967 | Kruse et al. | 264/45 |
| 3,426,804 | 2/1969 | Bluck | 139/11 |
| 3,459,621 | 8/1969 | Kamenyarzh | 139/13 |
| 3,709,969 | 1/1973 | Fairbanks | 139/11 X |
| 3,714,862 | 2/1973 | Berger | 87/33 |
| 3,719,210 | 3/1973 | Emerson et al. | 139/13 |
| 3,719,212 | 3/1973 | Emerson et al. | 139/11 UX |

FOREIGN PATENT DOCUMENTS

| | | | |
|---|---|---|---|
| 2301696 | 7/1973 | Fed. Rep. of Germany | 87/33 |
| 724604 | 2/1955 | United Kingdom | 87/33 |
| 1388843 | 3/1975 | United Kingdom | 87/33 |

*Primary Examiner*—Henry Jaudon

[57] ABSTRACT

An apparatus for weaving a three-dimensional article from a plurality of weaving elements comprising a plurality of carrier members each including a separate weaving element supply mounted thereon. The separate weaving elements are fed from the weaving element supplies to a plane of fabrication. Supporting means is provided for releasably maintaining the carrier members in a matrix to form a carrier plane. Movement means is provided to move the carrier members in predetermined paths relative to each other within the matrix to intertwine the weaving elements to form the woven article. A takeup means is provided to draw the woven article away from the carrier plane.

12 Claims, 9 Drawing Figures

APPARATUS FOR WEAVING A THREE-DIMENSIONAL ARTICLE

FIELD OF THE INVENTION

This invention relates generally to a weaving apparatus and, more particularly, to an apparatus for weaving a three-dimensional article from a plurality of individual weaving elements.

DESCRIPTION OF THE PRIOR ART

It has been a goal of textile manufacturers to be able to produce a truly three-dimensional fabric. A three-dimensional fabric is a woven or braided product which has thickness as well as length and width and which has been continuously formed by intertwining a plurality of textile or metallic strands together, some of which are at an angle from the traditional flat fabric weaving plane. The addition of thickness to a fabric significantly enhances the overall structural properties of the fabric, thereby making it particularly suitable to a variety of new and improved uses.

One specific example of an application of such a three-dimensional fabric is in the field of reinforced composite structures. The traditional standard way of forming a reinforced composite structure consists of stacking multiple layers of fabric or other woven material on top of one another, impregnating the stacked layers with an uncured resin or other suitable bonding agent and curing the resin to form the composite end product. Although the reinforced composites which are formed in this manner exhibit excellent structural characteristics in two directions (coplanar with the material), with the exception of the strength of the resin material itself, these composites have virtually no strength in a direction perpendicular to the plane of the fabric layers. Additionally, under certain types of stress conditions, composites formed in this manner have been known to fail due to the separation or delamination of the various fabric layers. The use of a single three-dimensional fabric instead of a plurality of stacked layered two-dimensional fabrics, provides improved strength to the reinforced composite, particularly in the previously weak third direction (perpendicular to the traditional fabric layers), due to the additional strands which extend substantially in the third direction. Additionally, the delamination problem is completely avoided since, with the interwoven three-dimensional fabric, there are no discrete fabric layers which can separate.

There are many other new and improved uses for such a three-dimensional fabric. Some of these uses include other applications in which multiple layers of two-dimensional fabrics are presently employed, such as, in sound or thermal insulation and in filtration materials. Additionally, such three-dimensional fabrics could provide for improved rug manufacture and improved reinforcement for certain metal structures.

Although various attempts have been made in the past to develop an apparatus which could successfully and efficiently produce the desired three-dimensional woven fabric in commercial quantities, all such efforts have failed, primarily due to the mechanical complexity and tremendous costs involved.

It is, therefore, an object of the present invention to provide an apparatus for weaving a commercially acceptable three-dimensional article at a relatively high speed.

It is another object of the present invention to provide such an apparatus which will produce such an article from a wide variety of different strands.

It is a further object of the present invention to provide such an apparatus which is simple in design and relatively inexpensive to operate.

SUMMARY OF THE INVENTION

Briefly stated, the foregoing objects, as well as additional objects and advantages which will become apparent from the following detailed description and the appended drawings and claims, are accomplished by the present invention which provides an apparatus for weaving a three-dimensional article from a plurality of weaving elements comprising a plurality of carrier members, each of which includes a separate weaving element supply mounted thereon to feed a weaving element from the carrier member to a plane of fabrication. A supporting means releasably maintains the carrier members in a predetermined matrix to form a carrier plane generally parallel to the fabrication plane. Movement means is employed for moving the carrier members in predetermined paths relative to each other within the matrix to intertwine the weaving elements to form the woven article. A takeup means draws the woven article away from the carrier plane. In one embodiment, the carrier matrix is rectangular, the carrier members forming columns and rows. In another embodiment, the carrier matrix is circular, the carrier elements residing in rows extending generally radially outwardly from the center of the circular matrix.

BRIEF DESCRIPTION OF THE DRAWINGS

The foregoing summary as well as the following detailed description of a preferred and an alternate embodiment of the present invention will be better understood when read in conjunction with the accompanying drawings, in which.

DESCRIPTION OF A PREFERRED EMBODIMENT

Figure 1:
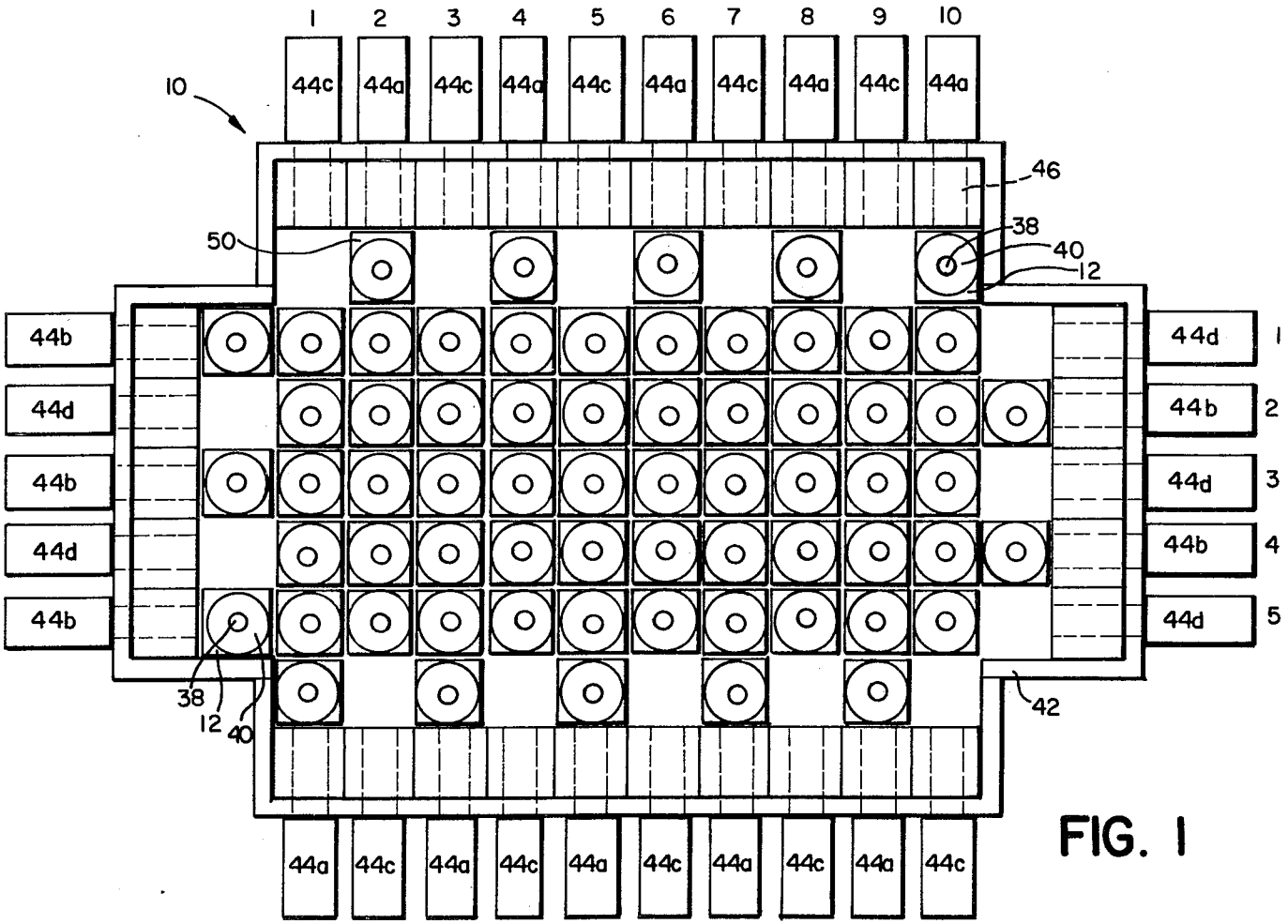
FIG. 1 is an elevation view of a preferred embodiment of the present invention.

Referring to the drawings, and particularly to FIGS. 1–4, there is depicted, in accordance with the present invention, an apparatus 10 for producing a three-dimensional woven article from a plurality of individual weaving elements. The apparatus 10 is comprised of a plurality of generally cube-shaped carrier members 12 arranged in a generally rectangular matrix as shown. In this particular embodiment, the rectangular matrix consists of six rows of carrier members and eleven columns of carrier members. Obviously, the particular dimensions of the carrier member matrix of this embodiment is not intended to be a limitation upon the present invention, it being fully understood that the carrier member matrix of weaving elements could be of any other suitable size, depending upon the size and shape requirements of the woven article. For example, the carrier member matrix could comprise a square matrix having 12 rows and 12 columns, or a rectangular matrix having 20 rows and 50 columns.

Figure 2:
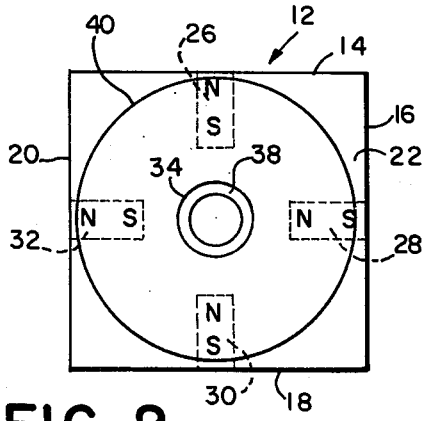
FIG. 2 is a plan view of one of the carrier members of FIG. 1.
Figure 3:
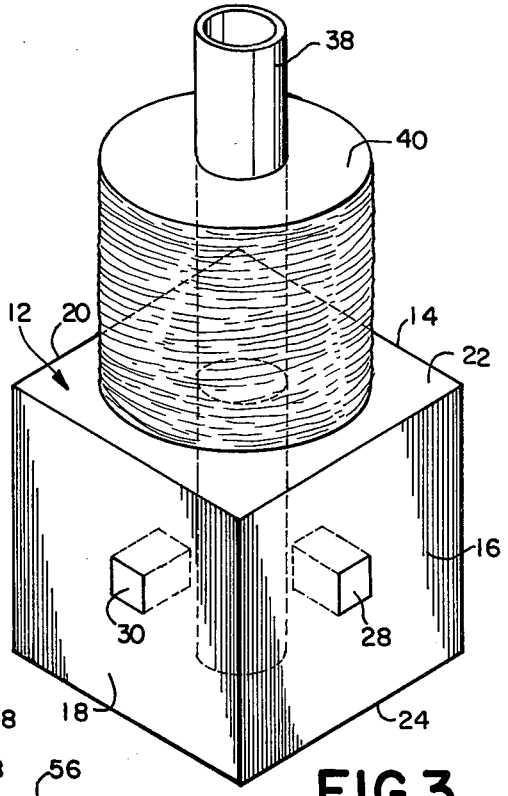
FIG. 3 is a perspective view of the carrier member of FIG. 2.
Figure 5:
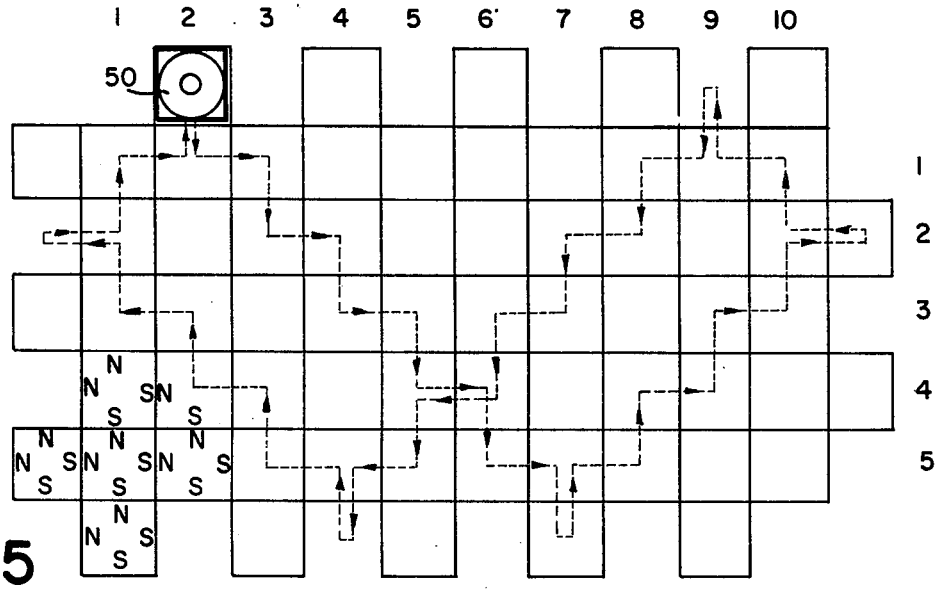
FIG. 5 is a partial schematic view of the apparatus of FIG. 1.

As is best seen in FIGS. 2 and 3, each carrier member 12 is generally in the form of a cube having four side faces 14, 16, 18 and 20, a top face 22 and a bottom face 24. Each cube may be constructed of aluminum, plastic or any other suitable lightweight non-magnetic material. Magnetic means, in the form of permanent bar type magnets 26, 28, 30 and 32 are disposed respectively within side faces 14, 16, 18 and 20 of each carrier member. The bar magnets are suitably imbedded and retained within each carrier member 12 in the manner shown in FIG. 2; that is, bar magnets 28 and 30 have their negative or south poles located at or near the outer surface of side faces 16 and 18, and bar magnets 26 and 32 have their positive or north poles located near the surface of side faces 14 and 20, respectively. The purpose of imbedding the bar magnets within the carrier members is to releasably maintain adjacent carrier members relative to each other within the columns and rows of the carrier member matrix through magnetic attraction forces. Therefore, the specific orientation of the bar magnets within the carrier members is particularly important so that when the individual carrier members are placed next to each other within the carrier member matrix, the polarity of the end of each bar magnet near the outer side surface of each carrier member side face is opposite to that of the end of the bar magnet in each adjacent carrier member side face so that the magnetic attraction of the adjacent opposite polarity magnetic poles releasably holds the adjacent carrier members together. FIG. 5 schematically depicts a portion of the carrier members on which the polarity of the bar magnets is indicated for the purpose of showing how the carrier members are held together within the carrier member matrix.

Figure 4:
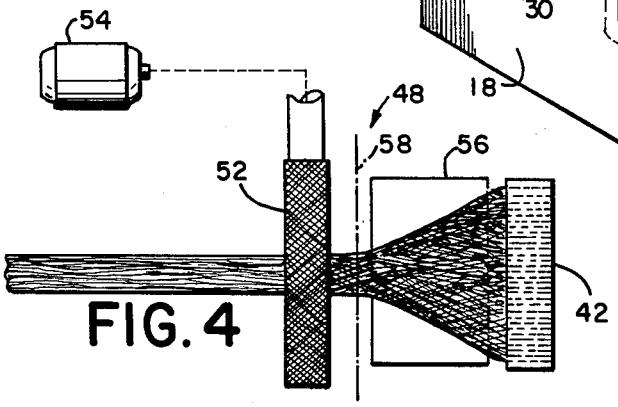
FIG. 4 is a plan view of the apparatus of FIG. 1.

Each carrier member also includes a generally circular opening 34 extending therethrough from the top face 22 to the bottom face 24. A cylindrical spool or spindle 38 is inserted and retained within each circular carrier member opening 34. A separate weaving element or strand supply 40 is rotatably mounted upon each of the spindles 38. The strands may comprise yarns, threads, rovings, monofilaments, multifilament fiber bundles, or other textile or metallic strand material. As shown in FIG. 4, an individual strand or weaving element extends from each of the weaving element supplies 40 under suitable tensioning (not shown).

Surrounding the rectangular matrix of carrier members 12 is a supporting means in the form of a generally rectangularly shaped frame 42. As shown in FIG. 1, the frame 42 is the equivalent of one carrier member larger than the carrier member matrix size; 12 columns wide and 7 rows long. Thus, for purposes which will hereinafter become apparent, the frame provides for an unoccupied space at either end of each column or row.

Positioned at suitable intervals around the four primary sides of the frame 42 is a plurality of electrical solenoids 44. Each of the solenoids 44 is of the same type in which the application of an electrical current (or energizing) results in a plunger 46 which projects outwardly from the body of the solenoid in a manner which is well known in the art. The removal of the electrical current (or deenergizing) results in the plunger 46 being withdrawn or retracted back toward the solenoid body by suitable known means, for example a coil spring (not shown). Additional details concerning the construction and operation of the solenoids 44 is not believed to be necessary for a complete understanding of the present invention. For purposes which will hereinafter become apparent, the solenoids 44 have been subdivided into four individual subgroups (44*a*, 44*b*, 44*c*, and 44*d*).

Viewing FIG. 1, it can be seen that all of the solenoids 44 are depicted as being in their unenergized state with all of the plungers 46 being retracted. Energizing one of the solenoids 44 will have the effect of extending its plunger 46, thereby moving one of the rows or columns of carrier members in a direction away from the solenoid. For example, it can be seen that by energizing the solenoid 44*a* associated with the top of column 2 of the carrier member matrix, the plunger 46 of the solenoid is projected outwardly, thereby acting as a pusher member to push all of the carrier members 12 of column 2 downwardly into the space provided by the frame 42. The force of magnetic attraction which holds the carrier member of column 2 to the carrier members of columns 1 and 3 is easily overcome by the action of the solenoid. Once the carrier members in column 2 are moved downwardly to their new positions (not shown), they are again retained in place by the magnetic attraction between them and the new adjacent carrier members in columns 1 and 3.

It can be seen that by selectively energizing the solenoids 44 in a particular predetermined sequence, particular columns and rows of carrier members are moved relative to each other, thereby moving individual carrier members 12 in predetermined paths relative to each other to intertwine or interweave the individual weaving elements extending outwardly from each of the carrier members 12 to form the three-dimensional woven article. One way of sequentially energizing the solenoids 44 in order to provide the three-dimensional woven article is illustrated in FIG. 5. The topmost carrier member in column 2 has been selected to illustrate the path of an individual carrier member and has been given the designation 50.

As can be seen from FIGS. 1 and 5, all of the solenoids designated 44*a* are energized first, thereby concurrently moving columns, 1, 3, 5, 7 and 9 upwardly and columns 2, 4, 6, 8 and 10 downwardly. Thus, carrier member 50 initially moves downwardly one position as shown on FIG. 5. Second, the 44*a* solenoids are deenergized and all of the solenoids designated 44*b* are energized, thereby concurrently moving rows 1, 3 and 5 toward the right and rows 2 and 4 toward the left. Carrier member 50 is thereby moved one position to the right as shown on FIG. 5. Third, the 44*b* solenoids are deenergized and all the solenoids designated 44*c* are energized, thereby concurrently moving columns 1, 3, 5, 7 and 9 downwardly and 2, 4, 6 and 8 upwardly. Carrier member 50 is thus moved downwardly one position. Finally, the 44*c* solenoids are deenergized and all of the solenoids designated 44*d* are energized, thereby moving rows 1, 3 and 5 to the left and rows 2 and 4 to the right. Carrier member 50 is again moved one position to the right. The cycle of sequentially energizing the four groups of solenoids 44*a*, 4*b*, 44*c*, and 44*d* is thereafter repeated, resulting in the carrier member 50 moving in the predetermined path illustrated in FIG. 5 until it once again returns to its original position at the top of column 2. The solenoids 44 are typically energized about ten times per second, thereby rapidly producing the three-dimensional article.

The travel of the respective carrier members throughout the matrix causes the strands to intersect or interweave throughout the matrix, the intersections of the strands provide an effective weave construction in a three-dimensional article.

The above-described sequential operation of the solenoids 44 is but one example of the way in which the three-dimensional woven article could be formed. It will be appreciated by those skilled in the art that many other ways of sequentally energizing the solenoids could be utilized to form a slightly different type of three-dimensional woven article. For example, the first steps of the operation could consist of energizing only the solenoids designated 44*a* which are at the top of the matrix, thereby moving only rows 2, 4, 6, 8 and 10 downwardly, leaving rows 1, 3, 5, 7 and 9 where they are. Next, only the solenoids designated 44*b* at the left side of the matrix could be energized, thereby moving rows 1, 3 and 5 to the right, leaving rows 2 and 4 where they are. Next, only the solenoids designated 44*a* at the bottom of the matrix could be energized, thereby moving columns 1, 3, 5, 7 and 9 upwardly and leaving rows 2, 4, 6, 8 and 10 where they are. Next, only the solenoids designated 44*b* at the righthand side of the matrix could be energized, thereby moving rows 2 and 4 to the left, leaving rows 1, 3 and 5 alone. The rest of the cycle could continue in a similar fashion, thereby resulting in eight individual operations in each cycle. Obviously, additional variations and commutations of such a cycle would be possible with different sizes and shapes of the carrier member matrix.

The predetermined paths of each of the carrier members 12 is selected so that each carrier member passes through a position along the exposed edge of the frame 42. It is at these positions that the strand supply is easily replenished.

As shown in FIG. 4, takeup means 48 is provided for drawing the three-dimensional woven article away from the plane of the carrier members. Such takeup means are generally conventional in the art, comprising a suitably knurled or other friction takeup roller members 52 which may be intermittently driven to rotation by a suitable electric motor 54 in timed relation to the actuation of the solenoids.

To provide a compact weave construction, reed means is provided between the supporting frame 42 and the takeup 48 as indicated diagrammatically at 56 in FIG. 4. The reed means comprises suitable pins or fingers which may penetrate the sheet of strands extending from the frame to the take-up adjacent the frame and be displaced along the length of the strands to drive the strand intersections formed by the weaving operation toward the takeup roller members 52 into the fell or weaving plane of the fabric indicated by the broken lines 58 in FIG. 4. The tightness of the weave construction may be regulated by controlling beat-up of the reed means 56 relative to the advance of the takeup means 48. In operation the pins or fingers are withdrawn during the displacement of the carrier members, and are inserted into the sheet of strands to the left of the carriers as seen in FIG. 4 and are displaced leftward toward the fell 58, and are then withdrawn and displaced rightward toward the carrier members for insertion into the sheet after a subsequent displacement of the carrier members.

ALTERNATE EMBODIMENT

Figure 6:
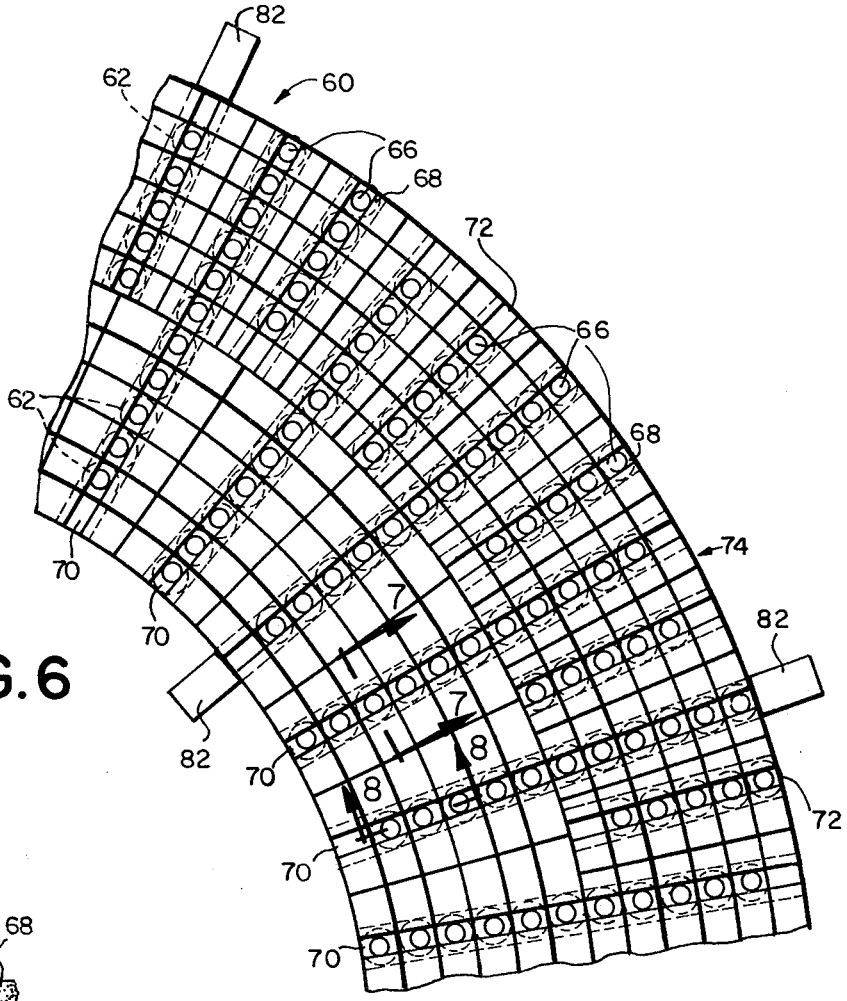
FIG. 6 is an elevation view of a portion of an alternate embodiment of the present invention.
Figure 7:
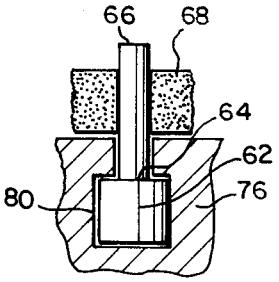
FIG. 7 is a sectional view of the apparatus depicted in FIG. 6 taken along the lines 7—7.

FIGS. 6 and 7 depict a representative portion of an alternate embodiment of the present invention. The generally circular apparatus 60 is particularly suitable for producing a three-dimensional woven article in the form of a hollow cylinder.

The apparatus 60 is comprised of a plurality of generally cylindrical-shaped carrier members 62 similar in construction to the above-described preferred embodiment carrier members 12 but without having the magnets imbedded in the side faces thereof. Each carrier member 62 includes a generally circular opening 64 within which is retained a cylindrical spool or spindle 66. A separate weaving element or strand supply 68 is rotatably mounted upon each of the spindles 66. Individual strands or weaving elements extend outwardly from each of the weaving element supplies 18 in the manner as was described above and as depicted in FIG. 4.

The carrier members 62 are arranged in a circular matrix comprising a plurality of spoke-like rows 70 extending generally radially outwardly from a common center point (not shown). Each radially extending carrier member row 70 includes an additional vacant space in order to provide for movement of the carrier members 62 inwardly or outwardly in the row. The individual carrier members 62 within adjacent rows generally align to form a plurality of concentric circles. For purposes which will hereinafter become apparent, a plurality of partial spoke-like rows 72 of carrier members 62 are interposed between the rows 70 near the radial outer ends thereof.

Figure 8:
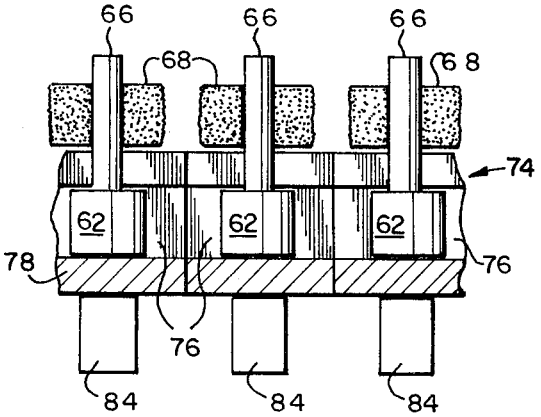
FIG. 8 is a sectional view of the apparatus depicted in FIG. 6 taken along the lines 8—8.

The supporting means 74 for releasably maintaining the carrier members 62 is shown in FIGS. 6, 7 and 8 and is somewhat more complicated than the supporting means for the above-described rectangular carrier member matrix. Basically, the supporting means 74 is comprised of a plurality of arcuate shaped members 76 of varying size. All of the arcuate members located along the same concentric circle are generally the same size and shape and when positioned adjacent one another form a continuous circle as shown in FIG. 6. The radial inner and outer sides of each arcuate member are suitably curved so as to complement the curvature of the abutting sides of the adjacent radially inner and radially outer arcuate members.

The arcuate members 76 are suitably supported by a base member 78 as shown in FIG. 8. The arcuate members 76 merely rest upon the base member 78 and are free to move circumferentially; all of the arcuate members in an individual concentric circle moving circumferentially around the circle in unison. The base member 78 may also include suitable track means (not shown) in order to maintain the arcuate members within their individual circular paths.

Each of the arcuate members 76 includes a suitably shaped slot 80 extending radially therethrough, as shown in detail in FIG. 7, for the purpose of releasably maintaining a carrier member 62 therein. The slot 80 is positioned in each arcuate member 76 so that when the arcuate members 76 of each concentric circle are suitably aligned, as shown in FIG. 6, the slots 80 within adjacent radially outer and inner arcuate members align to form the radially extending spoke-like rows 70 of carrier members 62.

Movement means, which could be similar in form to the electrically operated solenoid 44, as described above in conjunction with the rectangular carrier member matrix embodiment, are provided for moving the carrier members 62 in predetermined radial and circumferential paths relative to each other to form the woven article. Radial movement of the carrier members 62 is accomplished by sliding the carrier member rows 70 and 72 radially inwardly or radially outwardly along the aligned arcuate member slots 80. Solenoids, only two of which are shown, of the type described in detail above may be suitably positioned along the radial interior and the radial exterior of the circular carrier member matrix to alternately push the carrier member rows 70 and 72 inwardly and outwardly. Circumferential movement of the carrier members 62 is accomplished by circumferentially moving all of the arcuate members 76, within each circle, thereby also circumferentially moving the individual carrier members 62 residing within the individual arcuate member slots 80. The arcuate members 76 are moved circumferentially until they are again aligned, as shown, thereby providing for suitable alignment of the slots 80. Obviously, radial movement of the carrier member rows 70 and 72 cannot take place concurrently with the circumferential movement of the circles of arcuate members 76. Circumferential movement of the circles of arcuate members may be caused by ratchet-like actuator means under the control of solenoid means insure precise displacement of the arcuate members 76 to establish the aligned radial rows as indicated diagrammatically at 84 in FIG. 8.

Figure 9:
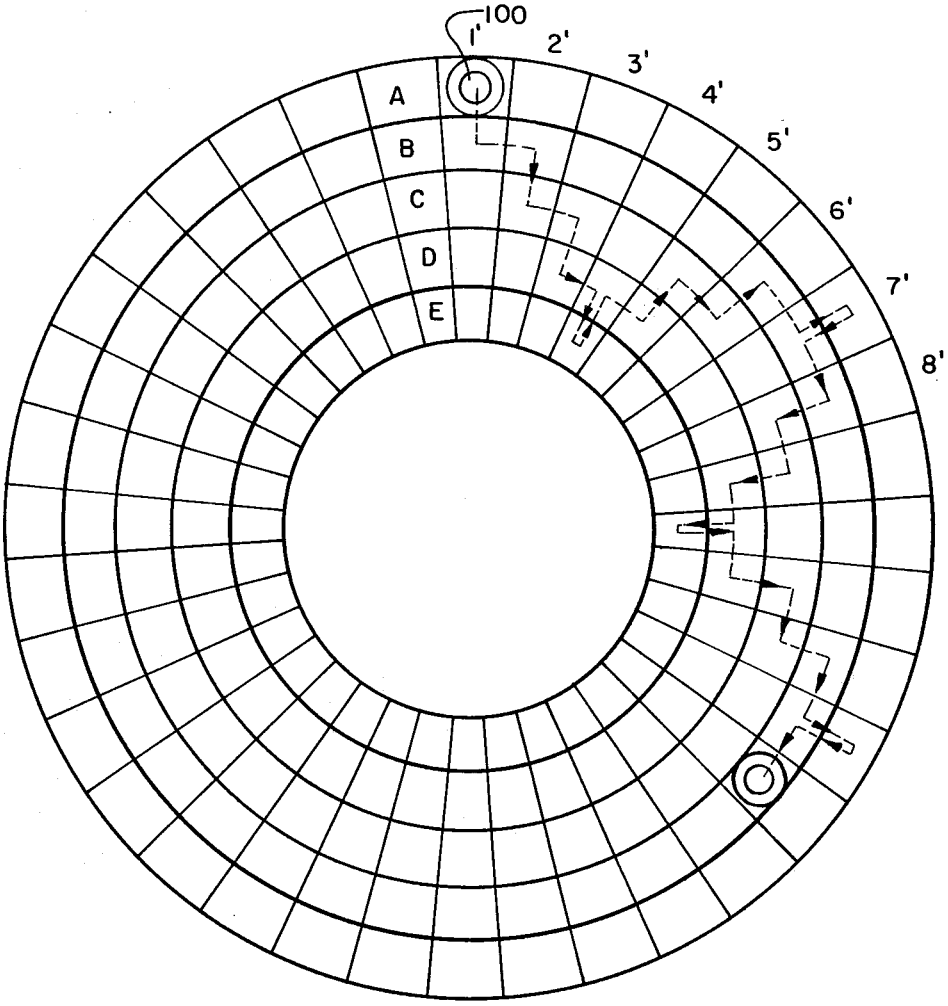
FIG. 9 is a schematic view of the path of a carrier member in the operation of an apparatus similar to that of the apparatus of FIG. 6.

There are many different permutations and combinations of possible ways of moving the rows and circles of carrier members 62 relative to each other to produce a variety of different woven articles. For purposes of illustration, FIG. 9 schematically depicts one way of moving a simplified version of the rows and circles of a circular carrier member matrix. Simplified circular matrix depicted in FIG. 9 includes only five concentric circles of arcuate members 76, designated A–E, only the middle three (B, C and D) of which move circumferentially. The circular matrix includes 36 radially extending rows of carrier members 62, the pertinent portions being designated 1'–8'. The path of selected individual carrier member 100 during the operation of the apparatus 60 is shown on FIG. 9 and will now be described.

Carrier member 100 is initially located on the outer circle A of carrier member row 1'. The first step of the operation of the apparatus includes moving all of the odd numbered rows (1', 3', etc.) radially inwardly and at the same time moving all of the even numbered rows (2', 4', etc.) radially outwardly. Thus, carrier member 100 moves inwardly to a position in circle B of row 1'. In the second step, circles B and D move circumferentially in a clockwise direction the length of one arcuate member 76. At the same time, circle C moves circumferentially in the counterclockwise direction the length of one arcuate member 76. Circles A and E do not move. Carrier member 100 now assumes a position in circle B at row 2'. The third step includes moving the odd numbered rows radially outwardly and the even numbered rows radially inwardly, thereby moving carrier member 100 to a position in circle C of row 2'. In the fourth step, circles B and D move counterclockwise one arcuate member length and circle C moves clockwise one arcuate member length. Thus, by the end of the first full cycle of the four-step operation, carrier member 100 is in circle C at row 3'. The above-described four-step cycle of operation is repeated continuously moving the carrier member 100 along the predetermined path as shown.

It will be appreciated that the above-described procedure for moving the circles and rows of carrier members 62 is but a single illustration of the operation of the apparatus 60. Various other ways of moving the rows and circles of carrier members could also be employed. For example, in the above-described cycle of operation, each circle could be circumferentially moved the length of two arcuate members 76, thereby altering the weave pattern of the three-dimensional woven product.

The purpose of the partial carrier member rows 72 near the radial exterior is to supplement the carrier member rows 70 is provide for a tighter weave at a position where the other carrier member rows 70 are further apart. The partial carrier member rows 72 may be a separately-controlled part of the cycle of operation of the apparatus (by moving inwardly, outwardly, and circumferentially, etc.) or may move only circumferentially under the control of the same solenoid which control the carrier member circles, depending upon the particular type of woven particle being produced.

Suitable takeup means, substantially the same as shown in FIG. 4, are also included for drawing the woven article away from the circular matrix of the apparatus 60.

From the foregoing description, it can be seen that the present invention provides a simple apparatus for weaving a three-dimensional article which is inexpensive to operate. It will be recognized by those skilled in the art that changes may be made to the above-described embodiments without departing from the broad inventive concepts of the invention. It is understood, therefore that this invention is not limited to the particular embodiments disclosed, but it is intended to cover all modifications which are within the scope and spirit of the invention as defined by the appended claims.

I claim:

1. An apparatus for weaving a three-dimensional article from a plurality of weaving elements comprising:

a plurality of generally cube-shaped carrier members, each carrier member including a separate weaving element supply mounted thereon to feed a weaving element from the carrier member to a plane of fabrication;

supporting means for releasably maintaining the carrier members in a matrix of columns and rows to form a carrier plane generally parallel to the fabrication plane including magnetic means disposed within the sides of said cube-shaped carrier member lying within the carrier plane, said magnetic means interacting to releasably maintain said carrier members in said columns and rows within said carrier plane;

movement means for moving said carrier members in predetermined paths relative to each other in the carrier plane to intertwine said weaving elements to form said woven article; and take-up means for drawing the woven article away from the carrier plane.

2. An apparatus for weaving a three-dimensional article from a plurality of weaving elements comprising:

a plurality of carrier members arranged in a matrix of columns and rows in a carrier plane generally parallel to a plane of fabrication, each carrier member including magnetic means for releasably maintaining said carrier members within said columns and rows relative to each other, each of said carrier members further including a separate weaving element supply mounted thereon to feed a weaving element from the carrier member to the fabrication plane;

movement means for moving said carrier members in predetermined paths relative to each other within the carrier plane to intertwine said weaving elements to form said woven article; and take-up means for drawing the woven article away from the carrier plane.

3. The apparatus as recited in claim 2 wherein said magnetic means includes permanent magnets disposed within the sides of the carrier members lying in the carrier plane.

4. The apparatus as recited in claim 1, 2, or 3 wherein said movement means comprises a plurality of electrical solenoids having pusher members which project therefrom when said solenoids are electrically energized, said solenoids being selectively energized to sequentially push predetermined columns and rows of carrier members relative to each other within the carrier plane, to move the carrier members in said predetermined paths.

5. The apparatus as recited in claim 4 wherein each carrier member periodically passes through a predetermined location within the carrier plane to facilitate replenishment of the carrier member's weaving element supply.

6. An apparatus for weaving a three-dimensional article from a plurality of weaving elements comprising:

a plurality of carrier members, each carrier members including a separate weaving element supply mounted thereon to feed a weaving element from the carrier member to a plane of fabrication;

supporting means for releasably maintaining the carrier members in a circular matrix having a plurality of spoke-like rows extending generally radially outwardly from a common center to form a carrier plane generally parallel to the fabrication plane;

movement means for moving the carrier members in predetermined radial and circumferential paths relative to each other within said matrix in the carrier plane to intertwine said weaving elements to form said woven article; and takeup means for drawing the woven article away from the carrier plane.

7. The apparatus as recited in claim 6 wherein the supporting means includes a base member and a plurality of arcuate shaped members positioned on the base member adjacent each other to form a plurality of concentric circles.

8. The apparatus as recited in claim 7 wherein the carrier members are generally cylindrical in shape.

9. The apparatus as recited in claim 8 wherein each of the arcuate shaped members includes a slot extending radially therethrough for maintaining a carrier member therein to form the spoke-like carrier member rows.

10. The apparatus as recited in claim 9 wherein the movement means comprises a plurality of electrical solenoids having pusher members which project therefrom when the solenoids are energized, the solenoids being selectively energized to sequentially push predetermined spoke-like rows of carrier members relative to each other to move the carrier members in the predetermined paths.

11. The apparatus as recited in claim 10, further including rachet-like actuator means for moving the arcuate shaped members circumferentially.

12. The apparatus as recited in claim 6 further including a plurality of additional partial spoke-like rows of carrier members, the partial rows being interposed between the carrier member rows at the radial exterior ends thereof to provide a woven article having a tigher weave.

* * * * *